US007828533B2

(12) United States Patent
Podmore

(10) Patent No.: US 7,828,533 B2
(45) Date of Patent: Nov. 9, 2010

(54) POSITIVE DISPLACEMENT MOTOR/PROGRESSIVE CAVITY PUMP

(75) Inventor: Christopher S. Podmore, Houston, TX (US)

(73) Assignee: National-Oilwell, L.P., Houston, TX (US)

( * ) Notice: Subject to any disclaimer, the term of this patent is extended or adjusted under 35 U.S.C. 154(b) by 947 days.

(21) Appl. No.: 11/625,975

(22) Filed: Jan. 23, 2007

(65) Prior Publication Data

US 2007/0172371 A1 Jul. 26, 2007

Related U.S. Application Data

(60) Provisional application No. 60/762,599, filed on Jan. 26, 2006.

(51) Int. Cl.
*F01C 1/10* (2006.01)
*F01C 5/00* (2006.01)
*F03C 2/00* (2006.01)

(52) U.S. Cl. ..... 418/48; 418/153; 418/178

(58) Field of Classification Search ..... 418/48, 418/152, 153, 166, 171, 178, 179
See application file for complete search history.

(56) References Cited

U.S. PATENT DOCUMENTS 1,378,442 A * 5/1921 Chalfant ..... 72/370.01
4,909,337 A * 3/1990 Kochnev et al. ..... 418/48
5,395,221 A * 3/1995 Tucker et al. ..... 418/48
6,102,681 A * 8/2000 Turner ..... 418/48
6,309,195 B1 * 10/2001 Bottos et al. ..... 418/48
6,358,027 B1 * 3/2002 Lane ..... 418/48
6,604,922 B1 * 8/2003 Hache ..... 418/48

OTHER PUBLICATIONS

International Search Report and Written Opinion for Appl. No. PCT/US2007/060954; dated Mar. 27, 2008; (8 p.).

* cited by examiner

*Primary Examiner*—Theresa Trieu
(74) *Attorney, Agent, or Firm*—Victor Segura

(57) ABSTRACT

Disclosed is a progressive cavity device. In some embodiments, the device includes a stator with an inner surface having a number of lobes and a rotor disposed within the stator and having a different number of lobes. The stator lobes define a major diameter and a minor diameter, where the major diameter circumscribes the stator lobes and the minor diameter inscribes the stator lobes. A rotor-stator, defined as the major diameter divided by the minor diameter, is selected from the group consisting of 1.350 or less for a progressive cavity device with a stator having two lobes, 1.263 or less for three lobes, 1.300 or less for four lobes, 1.250 or less for five lobes, 1.180 or less for six lobes, 1.175 or less for seven lobes, 1.150 or for eight lobes, 1.125 or less for nine lobes, and 1.120 or less for ten lobes.

22 Claims, 9 Drawing Sheets

PRIOR ART – CONVENTIONAL ROTOR-STATOR ASSEMBLY

PRIOR ART – CONVENTIONAL ROTOR-STATOR ASSEMBLY

PRIOR ART – CONVENTIONAL ROTOR-STATOR ASSEMBLY

PRIOR ART – CONSTANT WALL STATOR

POSITIVE DISPLACEMENT MOTOR/PROGRESSIVE CAVITY PUMP

CROSS-REFERENCE TO RELATED APPLICATIONS

This application claims the benefit of 35 U.S.C. 111(b) provisional application Ser. No. 60/762,599 filed Jan. 26, 2006, and entitled "Positive Displacement Motor/Progressive Cavity Pump With Novel Stator Design", which is hereby incorporated herein by reference in its entirety.

STATEMENT REGARDING FEDERALLY SPONSORED RESEARCH OR DEVELOPMENT

Not applicable.

FIELD OF THE INVENTION

The present invention relates generally to positive displacement motors and progressive cavity pumps. More particularly, the present invention relates to a rotor, a stator, and a rotor-stator assembly for a progressive cavity pump and/or positive displacement motor.

BACKGROUND

A progressive cavity pump, comprising a rotor and a stator, transfers fluid by means of a sequence of discrete cavities that move through the pump as the rotor is turned within the stator. Transfer of fluid in this manner results in a volumetric flow rate proportional to the rotational speed of the rotor within the stator, and relatively low levels of shearing applied to the fluid. Hence, progressive cavity pumps have typically been used in fluid metering and pumping of viscous or shear sensitive fluids.

A progressive cavity pump (PCP) may be used in reverse as a positive displacement motor to convert the hydraulic energy of a high pressure fluid into mechanical energy in the form of speed and torque output, which may be harnessed for a variety of applications, including downhole drilling. A positive displacement motor (PDM) comprises a power section including a rotor disposed within a stator, a bearing assembly, and a driveshaft. The driveshaft is coupled to the rotor of the power section and supported by the bearing assembly. Fluid is pumped under pressure through the power section, causing the rotor to rotate relative to the stator, thereby rotating the coupled driveshaft. In general, the rotor has a rotational speed proportional to the volumetric flow rate of fluid passing through the power-section. Another component, for example, a drill bit for downhole drilling, may be attached to the driveshaft. As high pressure fluid is pumped through the power section, rotary motion is transferred from the rotor to the drill bit through the bearing assembly and driveshaft, permitting the rotor to turn the drill bit.

A PCP or power section of a PDM generally includes a helical-shaped rotor, typically made of steel that may be chrome-plated or coated for wear and/or corrosion resistance, and a stator, typically a heat-treated steel tube lined with a helical-shaped elastomeric insert. FIG. 1 illustrates a perspective, cut-away view of a conventional rotor-stator assembly 5 comprising a rotor 10 disposed within a stator 20. This rotor-stator assembly 5 may be employed as a PCP or the power section of a PDM. FIG. 2 illustrates a cross-sectional view of the conventional rotor-stator assembly 5 depicted in FIG. 1. As shown in this figure, the rotor 10 has one fewer lobe 15 than the stator 20. When the two components are assembled, a series of cavities 25 are formed between the outer surface 30 of the rotor 10 and the inner surface 35 of the stator 20. Each cavity 25 is sealed from adjacent cavities by seal lines formed along the contact line between the rotor 10 and the stator 20. The center 40 of the rotor 10 is offset from the center 45 of the stator 20 by a fixed value known as the "eccentricity" of the rotor-stator assembly 5.

During operation of a PDM, high pressure fluid is pumped into one end of the power section where it fills the first set of open cavities. The pressure differential across the two adjacent cavities forces the rotor to turn. As previously stated, a PCP may be described as operating in reverse of a PDM, meaning the application of speed and torque to the PCP rotor causes the rotor to rotate within the stator, resulting in fluid flow through the length of the PCP, whereas fluid flow through the power section of a PDM causes the rotor to turn. In both types of assemblies, adjacent cavities are opened and filled with fluid as the rotor turns. As this rotation and filling process repeats in a continuous manner, fluid flows progressively down the length of the PCP or the power section of the PDM. Moreover, as the rotor turns inside the stator, the rotor's center moves in a circular motion about the stator's center. Because the rotor center is offset from the stator center, out of balance forces are generated by the rotation or nutation of the rotor within the stator. Without being limited by theory, it is believed that the greater the eccentricity of the PCP or power section of the PDM, the higher these out of balance or centrifugal forces.

Rotor-stator assembly failures may occur due to the destruction of the stator elastomer. Mechanical failure of the elastomer occurs when it is overloaded beyond its stress and strain limits, such as may be caused by a high compression fit between the rotor and stator. Thermal failure of the elastomer occurs when the temperature of the elastomer exceeds its rated temperature for a prolonged period. Even for shorter periods of time, increasing elastomer temperature causes elastomer physical properties to weaken, resulting in a shortened elastomer life.

There are several mechanisms or modes of heat generation that may elevate the elastomer temperature above its rated temperature as follows: interference, hysteresis, centrifugal forces, and downhole sources. Interference between the rotor and the stator is necessary to seal the discrete cavities. Centrifugal forces are exerted on the elastomer by the rotor as the rotor nutates within the stator. The combined effects of interference, centrifugal forces, and sliding or rubbing of the rotor within the stator generate heat within the stator elastomer, causing the temperature of the elastomer to rise. Also, as the rotor nutates within the stator, the elastomer compresses and expands repeatedly. Heat is generated by internal viscous friction of the elastomer molecules, a phenomenon known as hysteresis. Furthermore, heat may be generated by other downhole sources. Heat from these mechanisms—interference, centrifugal forces, hysteresis, and other downhole sources—may cause the elastomer temperature to rise above its rated temperature, resulting in shortened elastomer life or its failure.

FIG. 3 illustrates a conventional rotor-stator assembly 50 that includes a rotor 55 inside a stator 60. The stator 60 further includes an elastomeric liner 62 inside an outer housing 65. This conventional rotor-stator design and others similar to it are prone to high centrifugal forces as the rotor 55 turns within the stator 60 due to the high eccentricity of the rotor-stator assembly 50. As described above, these forces generate heat causing the elastomer temperature to rise during operation of the rotor-stator assembly 50. Additionally, the elastomer design itself inhibits the ability of the elastomer 62 to dissipate heat due to the liner thickness and its relatively low thermal conductivity. Assuming all other factors remain constant, the greater the thickness of the elastomer and the lower its thermal conductivity, the greater the capacity of the elastomer to retain heat.

Attempts have been made to modify the conventional design of the stator elastomer in an effort to reduce heat retention by the elastomer. FIG. 4 illustrates a modified stator 70, referred to as a constant wall stator, comprising an elastomeric liner 75 with a reduced, as compared to elastomeric liner 62 illustrated in FIG. 3, uniform thickness inside an outer housing 80. By reducing the thickness of the elastomeric liner 75, its ability to retain heat is also reduced. However, this design modification does not directly address the sources of that heat—the centrifugal forces resulting from nutation of the rotor within the stator and the eccentricity of the rotor-stator assembly. Moreover, this design configuration adds manufacturing complexity, and therefore expense, due to the non-cylindrical inner surface or shape of the stator housing 80. Still further, this design configuration also limits the range of applications for which the housing 80 may be used. With a housing having a cylindrical inner shape or surface, the lobe configuration in the rotor-stator assembly (e.g., the number of lobes) is commonly changed simply by replacing the elastomeric liner in the stator, whereas the stator housing design illustrated in FIG. 4 is limited to the lobe configuration shown (i.e., three lobed stator configuration).

Due to the shortcomings of conventional rotor-stator assemblies described above, there remains a need for an improved rotor and stator for use in a PCP or power section of a PDM. Such an improved rotor and stator would be particularly well received if it offered the potential to reduce heat generation from centrifugal forces, heat retention by elastomeric components (e.g., the elastomeric stator liner), if present, and/or manufacturing costs while retaining design configuration flexibility.

SUMMARY OF THE DISCLOSURE

A rotor-stator assembly for a progressive cavity pump and/or positive displacement motor is disclosed, wherein the rotor-stator assembly permits reduced heat generation due to centrifugal forces caused by nutation of the rotor within the stator, heat retention by the stator's elastomeric liner, if present, and manufacturing costs for the stator housing while retaining the ability of the stator to assume various lobe configurations.

In some embodiments, the stator includes a housing having a through bore defining an inner surface, where the inner surface has a plurality of lobes. The plurality of lobes defines a major diameter circumscribing the plurality of lobes and a minor diameter inscribing the plurality of lobes. A stator ratio is equal to the major diameter divided by the minor diameter. The stator ratio is selected from the group consisting of 1.350 or less for a stator with two lobes, 1.263 or less for a stator with three lobes, 1.300 or less for a stator with four lobes, 1.250 or less for a stator with five lobes, 1.180 or less for a stator with six lobes, 1.175 or less for a stator with seven lobes, 1.150 or less for a stator with eight lobes, 1.125 or less for a stator with nine lobes, and 1.120 or less for a stator with ten lobes.

In some embodiments, the rotor includes an outer surface having at least one lobe. The at least one lobe defines a major diameter circumscribing the at least one lobe and a minor diameter inscribing the at least one lobe. A rotor ratio is equal to the major diameter divided by the minor diameter. The rotor ratio is selected from the group consisting of 1.350 or less for a rotor with one lobe, 1.263 or less for a rotor with two lobes, 1.300 or less for a rotor with three lobes, 1.250 or less for a rotor with four lobes, 1.180 or less for a rotor with five lobes, 1.175 or less for a rotor with six lobes, 1.150 or less for a rotor with seven lobes, 1.125 or less for a rotor with eight lobes, and 1.120 or less for a rotor with nine lobes.

In some embodiments, the progressive cavity device includes a stator and a rotor. The stator has an inner surface with a first number of lobes, where the lobes define a major diameter circumscribing the lobes and a minor diameter inscribing the lobes. The rotor is disposed within the stator and has a second number of lobes different from the first number of lobes. A rotor-stator ratio equals the major diameter divided by the minor diameter. The rotor-stator ratio is selected from the group consisting of 1.350 or less for a progressive cavity device with a stator having two lobes, 1.263 or less for a progressive cavity device with a stator having three lobes, 1.300 or less for a progressive cavity device with a stator having four lobes, 1.250 or less for a progressive cavity device with a stator having five lobes, 1.180 or less for a progressive cavity device with a stator having six lobes, 1.175 or less for a progressive cavity device with a stator having seven lobes, 1.150 or less for a progressive cavity device with a stator having eight lobes, 1.125 or less for a progressive cavity device with a stator having nine lobes, and 1.120 or less for a progressive cavity device with a stator having ten lobes The various characteristics described above, as well as other features of the disclosed apparatus, will be readily apparent to those skilled in the art upon reading the following detailed description and by referring to the accompanying drawings.

BRIEF DESCRIPTION OF THE DRAWINGS

For a more detailed description of the preferred embodiments, reference will now be made to the accompanying drawings, wherein.

NOTATION AND NOMENCLATURE

Figure 1:
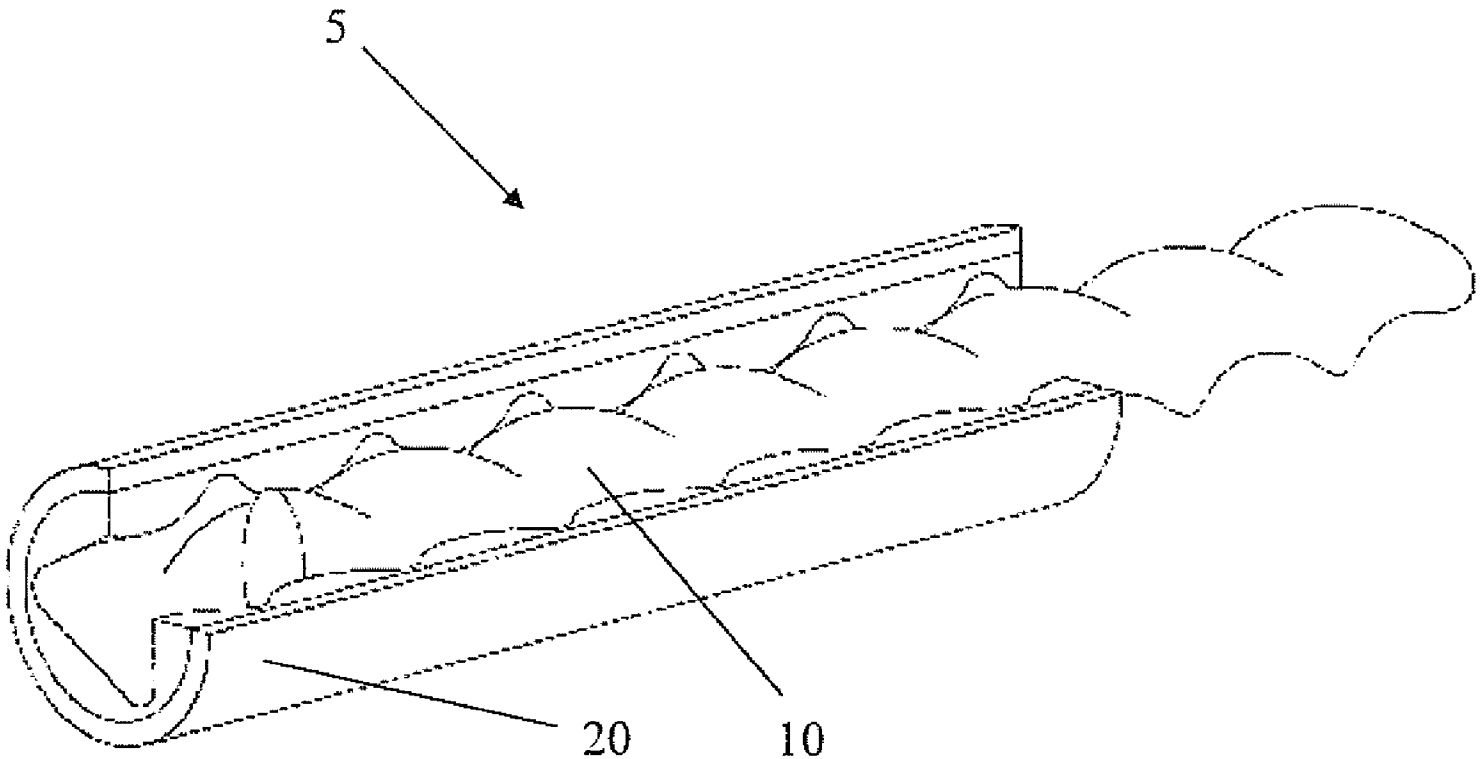
FIG. 1 depicts a perspective, partial cut-away view of a conventional rotor-stator assembly.

Certain terms are used throughout the following description and claims to refer to particular assembly components.

This document does not intend to distinguish between components that differ in name but not function. In the following discussion and in the claims, the terms "including" and "comprising" are used in an open-ended fashion, and thus should be interpreted to mean "including, but not limited to . . . ".

As used herein, and in the claims that follow, the term "progressive cavity device" refers collectively to a stator with a rotor disposed within.

DETAILED DESCRIPTION OF PREFERRED EMBODIMENTS

Various embodiments of a rotor-stator assembly for a positive displacement motor and/or a progressive cavity pump that offer the potential to reduce heat generation caused by centrifugal forces resulting from nutation of the rotor within the stator, heat retention by the stator elastomeric liner, if present, and manufacturing costs while retaining design configuration flexibility, will now be described with reference to the accompanying drawings. Like reference numerals are used for like features throughout the several views. There are shown in the drawings, and herein will be described in detail, specific embodiments of the rotor-stator assembly with the understanding that this disclosure is representative only and is not intended to limit the invention to those embodiments illustrated and described herein. The embodiments of the rotor-stator assembly disclosed herein may be used in any type of positive displacement motor (PDM) or progressive cavity pump (PCP). It is to be fully recognized that the different teachings of the embodiments disclosed herein may be employed separately or in any suitable combination to produce desired results.

Figure 5:
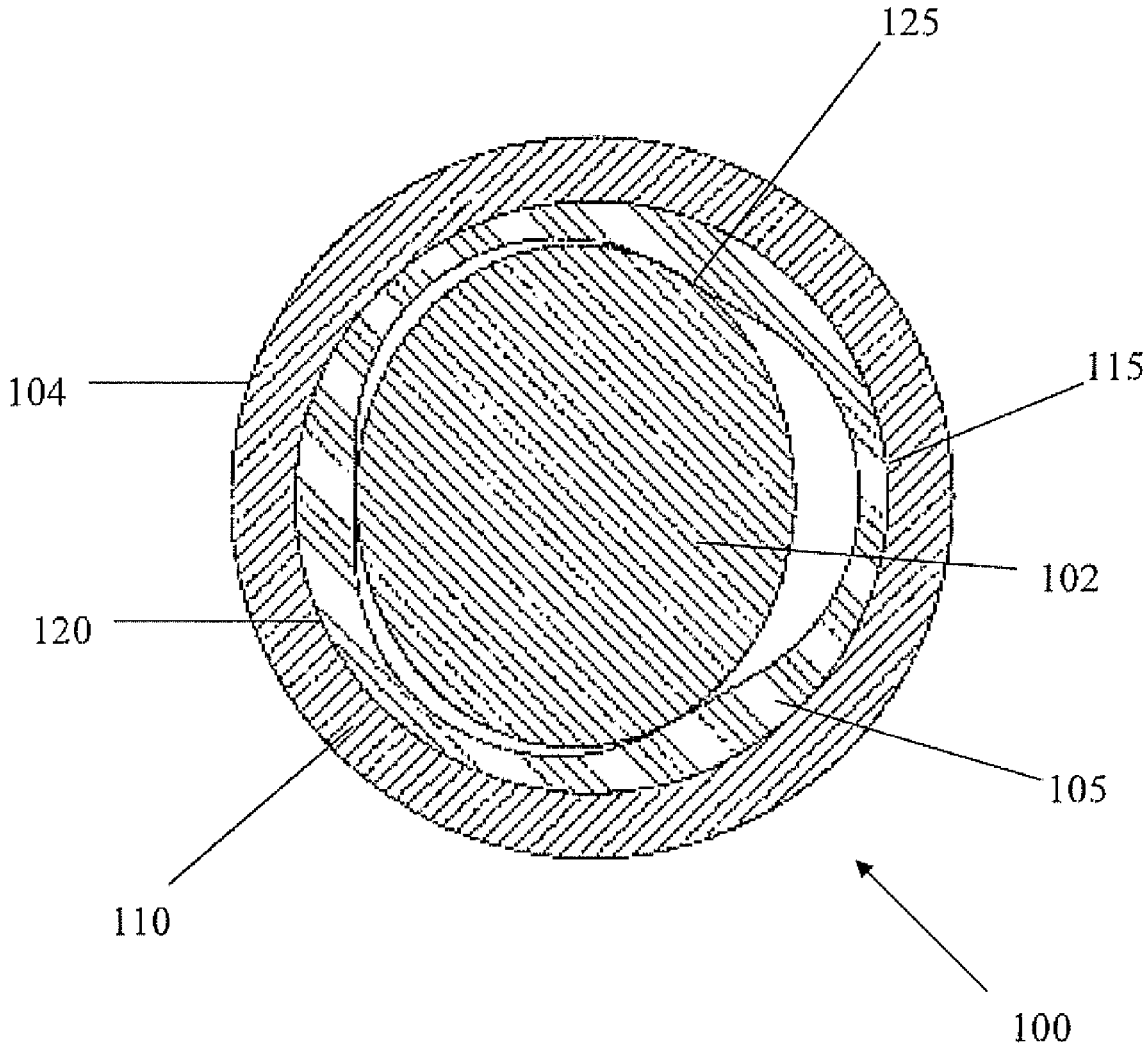
FIG. 5 depicts an embodiment of a rotor-stator assembly with a two in three lobe configuration made in accordance with the principles described herein.

FIG. 5 depicts a cross-sectional, end view of an embodiment of a rotor-stator assembly 100, including a rotor 102 within a stator 104. Assembly 100 may be a PCP or a power section of a PDM. Collectively, the rotor 102 and stator 104, as well as all other rotor-stator assemblies according to the present disclosure, are referred to herein as "progressive cavity devices". The stator 104 includes a relatively thin liner 105 disposed within, and surrounded by, an outer housing 110. The outer housing 110 includes a substantially cylindrical inner surface 115 that engages the outer surface 120 of the liner 105. Specifically, the shape and size (e.g., radius) of the inner surface 115 of housing 110 corresponds to the shape and size (e.g., radius) of the outer surface 120 of liner 105 such that the outer surface 120 of the elastomeric liner 105 statically engages the inner surface 120 of the housing 110. For instance, an interference fit may be formed between the liner 105 and the housing 110. In addition to, or as an alternative, the liner 105 may be bonded to the inner surface 115 of the housing 110. Although this exemplary configuration of the rotor-stator assembly 100 shown in FIG. 5 has a two in three lobe configuration, meaning a two lobe rotor 102 disposed within a three lobe stator 104, it should be appreciated that other embodiments may include other lobe numbers and combinations.

In general, the stator housing 110 may comprise any suitable material(s) including, without limitation, metals and metal alloys (e.g., stainless steel, titanium, etc.), non-metals (e.g., polymers), composite(s) (e.g., carbon fiber and epoxy composite), or combinations thereof. In one embodiment, stator housing 110 is preferably constructed of a heat-treated carbon steel alloy. Similarly, liner 105 may comprise any suitable materials including, without limitation, metals and metal alloys, non-metals, composites, or combinations thereof. In this embodiment, liner 105 is preferably constructed of an elastomer or synthetic rubber. Thus, liner 105 may be referred to herein as an "elastomeric liner".

The stator 104 depicted in FIG. 5 may be described in terms of a major diameter (SD) and a minor diameter (Sd). Major diameter (SD) is defined by the dashed circle circumscribing the radially outermost points or surfaces of lobes 125. Minor diameter (Sd) is defined by the dashed circle inscribing the innermost radial points or surfaces of the elastomeric liner 105. In general, the eccentricity of a rotor-stator assembly, including rotor-stator assembly 100 depicted in FIG. 5, is a function of the major diameter SD and the minor diameter Sd. For a rotor-stator assembly comprising a stator with more than one lobe (e.g., stator 104), the eccentricity, as used herein, equals (SD−Sd)/4. Without being limited by this or any particular theory, for a rotor-stator assembly comprising a stator with a single lobe, the eccentricity equals (SD−Sd)/2.

As described previously, centrifugal forces caused by nutation of a rotor inside a stator result in heat generation due to friction between the rotor and stator. In some conventional rotor-stator assemblies that include a stator with an elastomeric liner, the heat generation may cause the elastomer temperature to exceed its rated temperature. Without being limited by this or any particular theory, it is believed that the greater the eccentricity of the rotor-stator assembly, the greater the centrifugal forces and resulting heat generation, and the greater the potential for damage, breakdown, and/or failure of the elastomeric liner. Thus, it is desirable to reduce the eccentricity of the rotor-stator assembly.

According to the eccentricity equations described above, the eccentricity of a rotor-stator assembly may be decreased by reducing the difference between the major diameter SD and the minor diameter Sd of the stator. In other words, the eccentricity of a rotor-stator assembly may be decreased by reducing the ratio SD/Sd.

Figure 4:
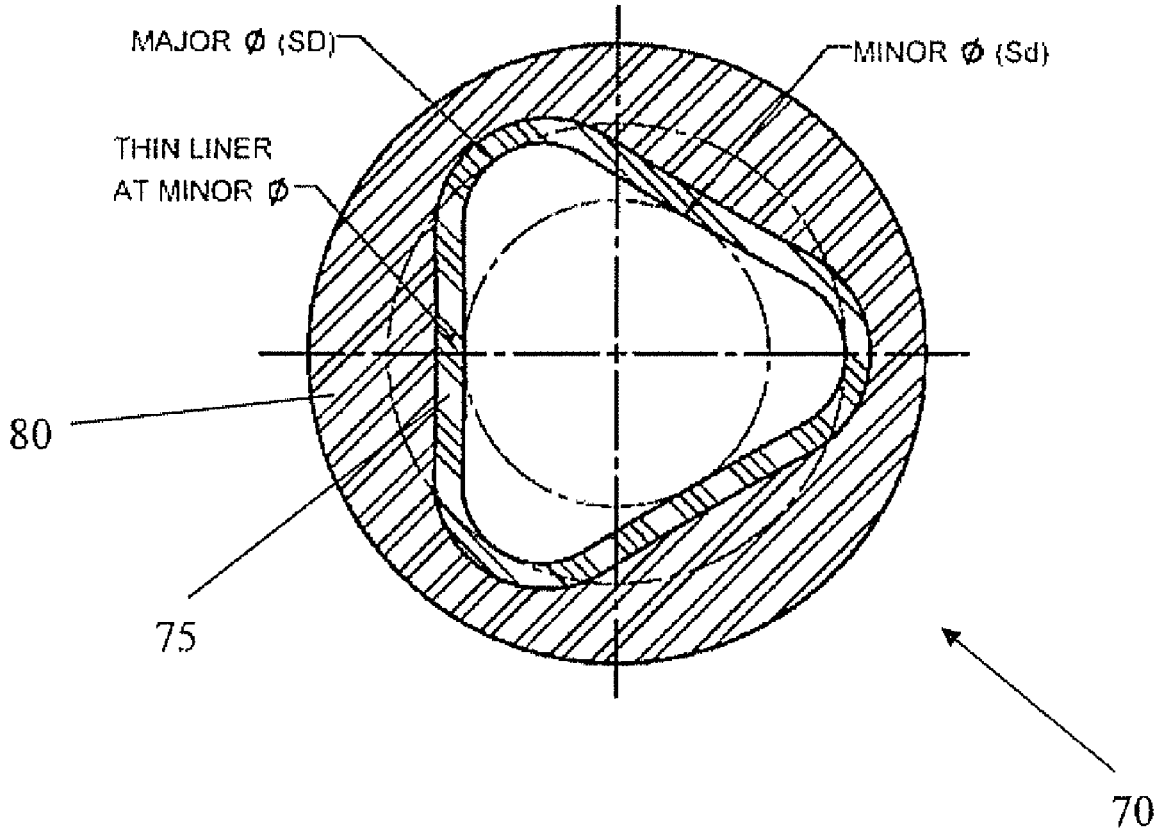
FIG. 4 depicts a cross-sectional view of a modified stator, also referred to as a constant wall stator.

Embodiments described herein have a maximum SD/Sd ratio of 1.263 for a rotor-stator assembly comprising a three-lobe stator, such as the three-lobe stator 100 depicted in FIG. 4. Stated differently, embodiments described herein have an SD/Sd ratio no more than 1.263 for a rotor-stator assembly comprising a three-lobe stator. For comparison purposes, a commonly employed conventional rotor-stator assembly having a three-lobe stator and a two-lobe rotor has an SD/Sd ratio near 1.65, significantly higher than 1.263. Further, another conventional prior art rotor-stator with a three-lobe stator and a two-lobe rotor has a SD/Sd ratio of 1.367, still higher than 1.263. As previously described, and without being limited by this or any particular theory, the lower the eccentricity of a rotor-stator assembly, the lower the centrifugal forces and resulting heat generation. Consequently, embodiments of rotor-stator assemblies including the stator 100 having a maximum SD/Sd ratio of 1.263 offer the potential to reduce centrifugal forces and heat generation within the rotor-stator assembly as compared to many conventional rotor-stator assemblies having a three-lobed stator.

In addition, and still referring to FIG. 5, it should be appreciated that the inner surface 115 of the stator housing 110 is cylindrical, unlike the cross-section of the prior art stator depicted in FIG. 4. In general, a stator housing with a cylindrical inner surface (e.g., inner surface 115 of stator housing 110) yields reduced manufacturing costs as compared to the prior art stator 70 depicted in FIG. 4 and other similarly designed stators having inner surfaces of more complex shape (e.g., a tri-oval surface generally similar to the shape of the desired liner internal profile). Further, a stator housing with a cylindrical inner surface offers the potential for greater versatility than a stator with a non-cylindrical inner surface. In particular, a stator with a cylindrical inner surface may be used with various lobe configurations. For example, the liner 105 of stator 104 shown in FIG. 5 may be removed and replaced with another liner having a different lobe configuration (e.g., a liner having a four lobed configuration). In contrast, the non-cylindrical inner surface of the prior art stator 70 depicted in FIG. 4, and other similar stator configurations, are limited to a particular lobe configuration. Specifically, any liner 75 inserted into the prior art stator 70 depicted in FIG. 4 can only accommodate a rotor with no more than two lobes.

Although the inner surface 115 of the stator housing 100 shown in FIG. 5 is substantially cylindrical and the liner 105 has a non-uniform wall thickness, thereby enabling the lobed-configuration, in other embodiments, the liner (e.g., liner 105) has a substantially uniform wall thickness, yet still enable a lobed-configuration satisfying the preferred maximum SD/Sd ratios described above. In such an embodiment, the housing includes a non-cylindrical outer surface that engages a non-cylindrical outer surface of the liner.

Figure 2:
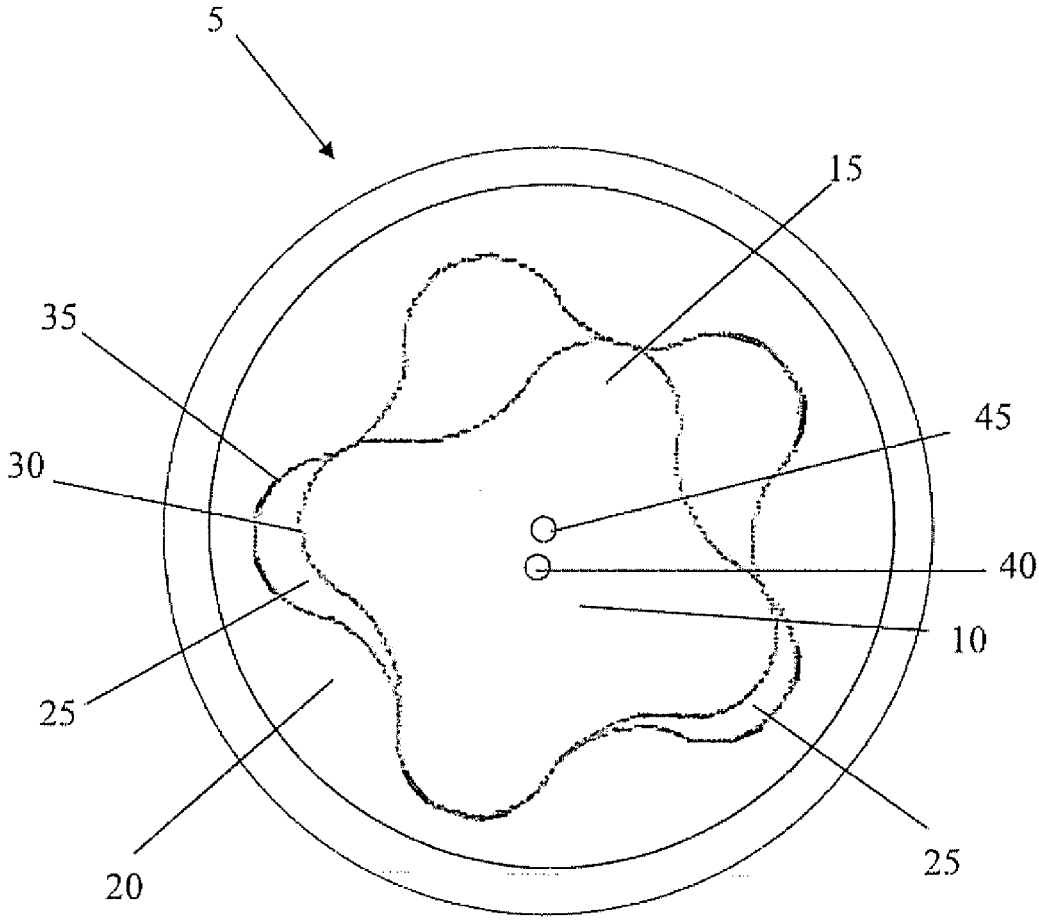
FIG. 2 depicts a cross-sectional view of a typical, conventional rotor-stator assembly.
Figure 3:
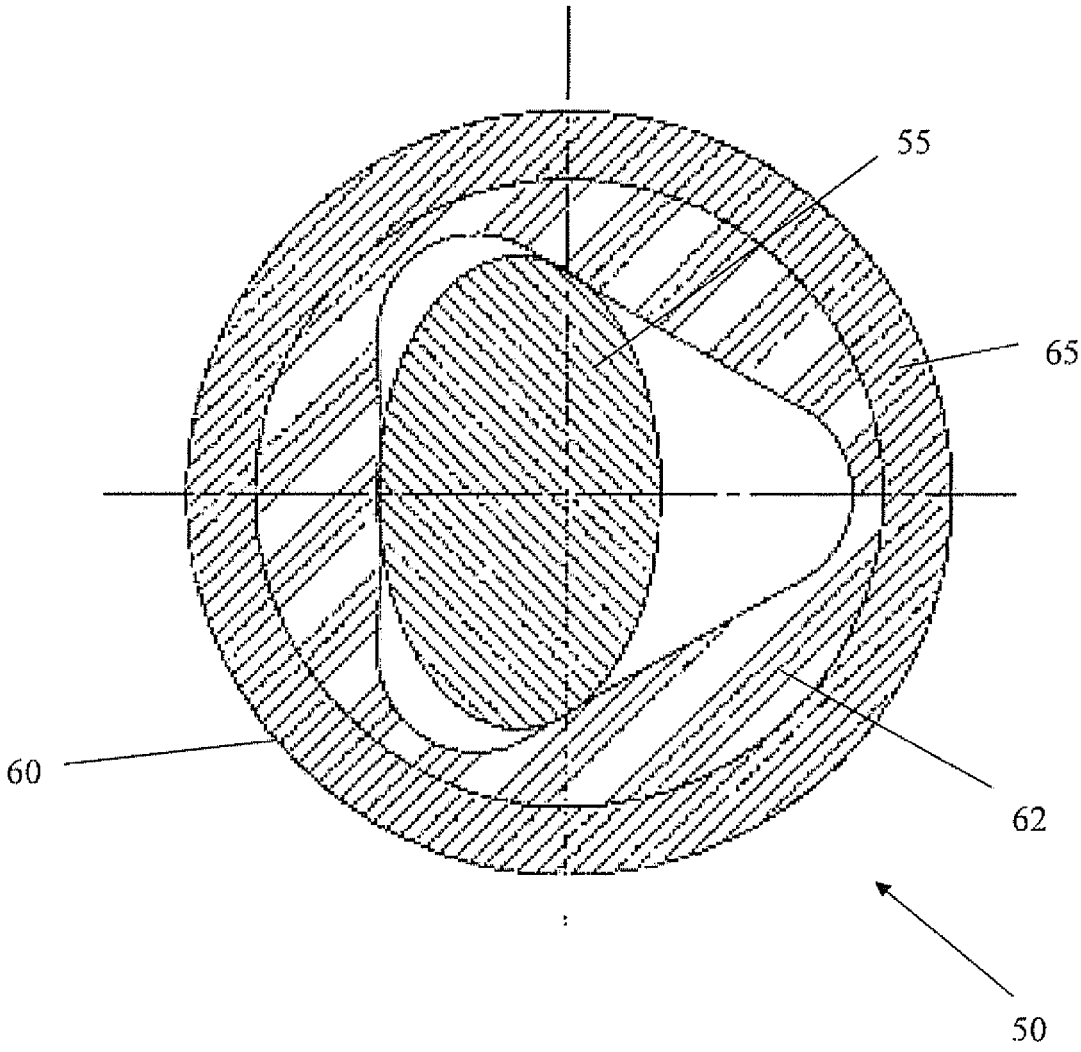
FIG. 3 depicts a cross-sectional view of another typical, conventional rotor-stator assembly.

Finally, the elastomeric liner 105 of the stator 104 depicted in FIG. 5 may be made significantly thinner than that of the prior art stators depicted in FIGS. 2 and 3. Given that the thermal conductivity of elastomeric materials is relatively low (i.e., relatively high resistance to heat transfer), the amount of heat retained by an elastomeric liner generally increases as the thickness of liner increases. Thus, the thinner the elastomeric liner, the less thermal energy retained by the elastomer. Therefore, providing a thinner elastomeric liner 105, as compared to the liners of the prior art stators typified by the stators depicted in FIGS. 2 and 3, offers the potential to reduce heat retention by the elastomeric liner 105, and thereby increase the life of the liner.

Figure 6:
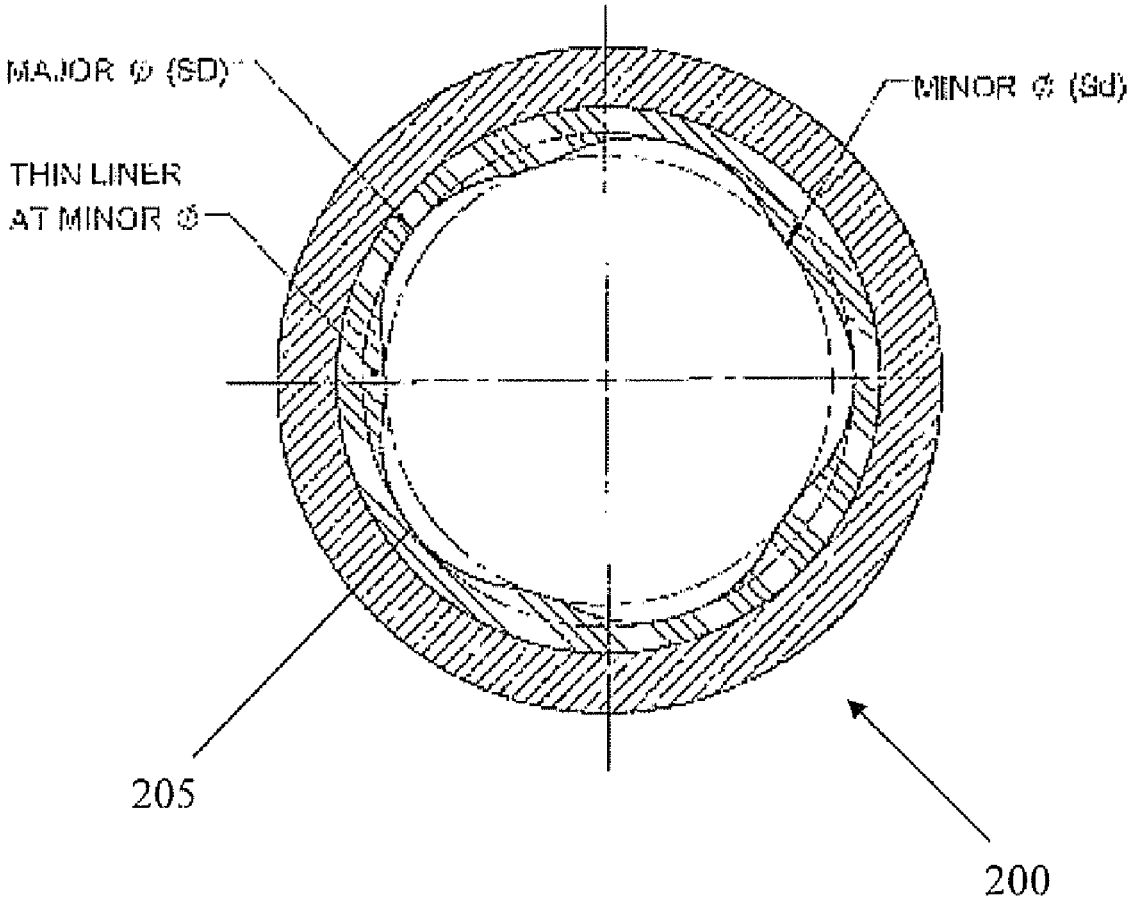
FIG. 6 depicts one illustrative embodiment of a stator with a five lobe configuration made in accordance with the principles described herein.

While the embodiment of stator 104 illustrated in FIG. 5 includes three lobes, other lobe configurations are also possible. For example, FIG. 6 depicts a cross-sectional, end view of another embodiment of a stator 200 including five lobes 205. Stator 200 has a maximum SD/Sd ratio of 1.25. Many conventional rotor-stator assemblies including a five-lobed stator configuration have SD/Sd ratios generally in the range 1.4 to 1.45. As compared to such conventional five-lobe designs, embodiments of stator 200 have a reduced SD/Sd ratio, and thus, for similar reasons as described above, offer the potential for lower centrifugal forces and associated thermal energy, reduced elastomeric liner thickness and heat retention in those embodiments including an elastomeric liner, and reduced manufacturing costs while retaining design configuration flexibility for those embodiments having a stator with a liner disposed within a housing.

Other embodiments with different lobe configurations (e.g., 6 lobe stator, 8 lobe stator, etc.) made in accordance with the principles described herein offer the potential for similar benefits and advantages. Specifically, Table 1 below lists maximum SD/Sd ratios for a variety of rotor-stator configurations made in accordance with the principles described herein. As the SD/Sd ratios listed are the maximum SD/Sd ratios, it should be understood that some embodiments may comprise SD/Sd ratios lower than those listed. For example, a rotor-stator assembly with a four in five lobe configuration, meaning a four-lobe rotor inside a five-lobe stator, may have an SD/Sd ratio equal to 1.100, which is less than the maximum value permitted, or 1.250.

TABLE 1

| No. of Rotor Lobes | No. of Stator Lobes | SD/Sd Ratio |
|---|---|---|
| 1 | 2 | 1.350 |
| 2 | 3 | 1.263 |
| 3 | 4 | 1.300 |
| 4 | 5 | 1.250 |
| 5 | 6 | 1.180 |
| 6 | 7 | 1.175 |
| 7 | 8 | 1.150 |
| 8 | 9 | 1.125 |
| 9 | 10 | 1.120 |

Figure 7:
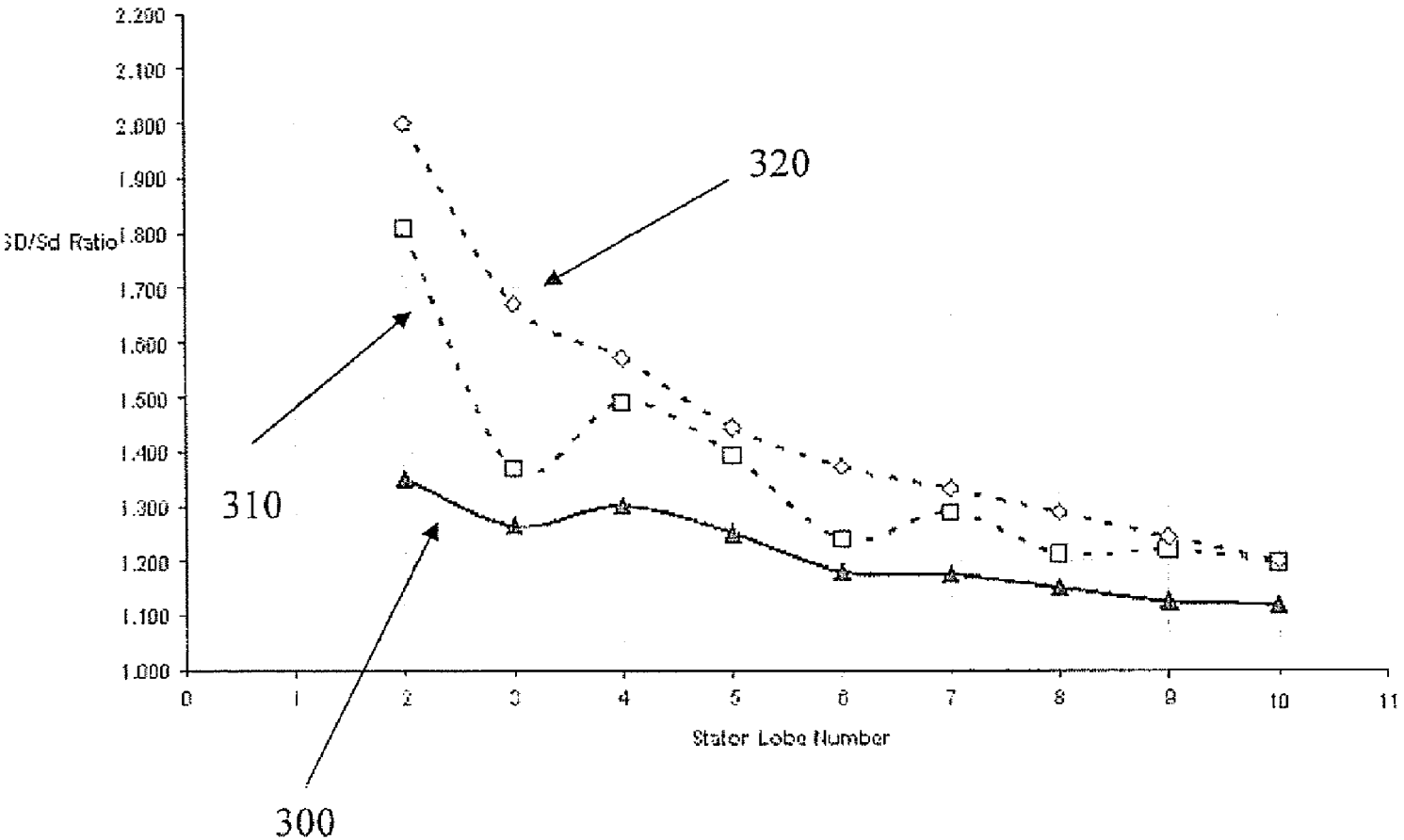
FIG. 7 is a line plot showing the maximum ratio of the stator major diameter to the stator minor diameter as a function of the number of stator lobes for stators made in accordance with the principles described herein as compared to particular known prior art stators.

Referring now to FIG. 7, there is shown a line plot of the maximum SD/Sd ratio 300 for a rotor-stator assembly in accordance with the principles described herein as a function of the stator lobe configuration of Table 1. For purposes of comparison, SD/Sd ratios for certain conventional prior art rotor-stator assemblies are plotted as a function of their stator lobe configuration. SD/Sd ratio 310 is relatively low, while SD/Sd ratio 320 is substantially higher. As seen in FIG. 7, rotor-stator assemblies constructed in accordance with the principles described herein have lower SD/Sd ratios as compared to these common prior art rotor-stator assemblies. Thus, embodiments of rotor-stator assemblies that satisfy the design criteria specified in Table 1 above share a common design feature, relatively low eccentricity (e.g., relatively low SD/Sd ratio). As previously discussed, rotor-stator assemblies exhibiting reduced eccentricity offer the potential for lower centrifugal forces resulting in lower out of balance forces and reduced heat generation. Further, for those embodiments including an elastomeric liner (e.g., FIG. 5), a reduced eccentricity enables a thinner wall elastomeric liner, which in turn offers the potential for lower heat retention and a longer life elastomeric liner.

It should be appreciated that that rotor-stator assemblies constructed in accordance with the principles described herein may have a variety of suitable configurations (e.g., with a liner, without a liner, having a housing with a cylindrical inner surface, etc.), but are preferably constructed in accordance with the SD/Sd ratios disclosed in Table 1 above. Assuming the preferred SD/Sd ratio criteria is satisfied, additional benefits potentially may be obtained, as previously described, by utilizing a thinner stator elastomeric liner, a stator housing with a cylindrical inner surface, etc. In some applications, however, it may be advantageous for the rotor-stator assembly to be configured such that it does not have one or more of these additional design features.

Figure 8:
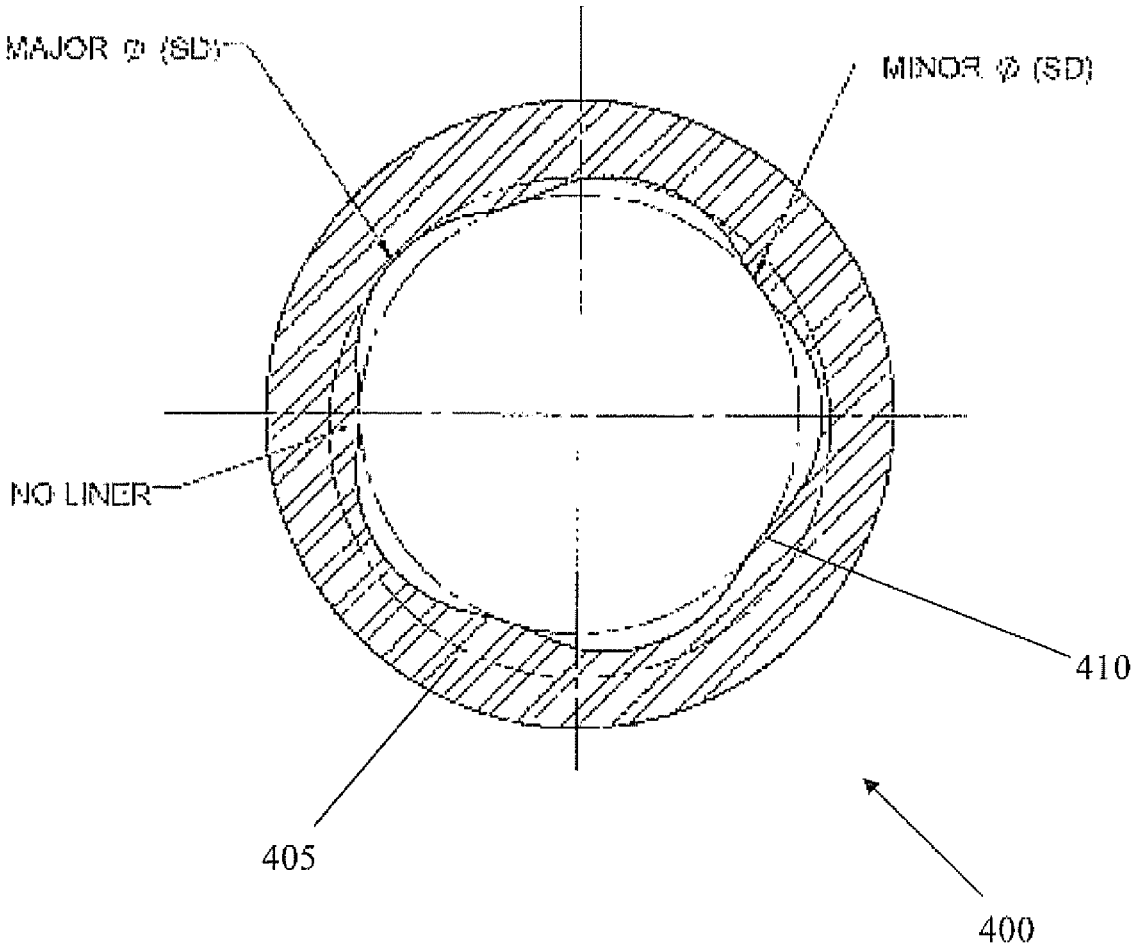
FIG. 8 depicts one illustrative embodiment of a stator with a five lobe configuration but no elastomeric liner in accordance with the principles described herein.

For example, a common failure mode in conventional rotor-stator assemblies is damage or destruction of the stator elastomer. To eliminate that as a potential failure mode, certain embodiments of the rotor-stator assembly designed in accordance with Table 1 are constructed such that the stator is free of (or constructed without) an elastomeric liner within the stator. In such embodiments, the stator is a solid, integral stator. For example, FIG. 8 depicts a cross-sectional, end view of one representative liner-less stator 400 according to the present disclosure, wherein the stator 400 comprises a housing or shell 405 with five lobes 410 defined along its inner surface. Stator 400 includes no elastomeric liner. By eliminating the elastomeric liner, such embodiments also eliminate the component most likely to fail. In the absence of an elastomeric liner, the inner surface of the stator defines the stator lobe configuration and is the surface contacted by the rotor as it nutates within the stator. Otherwise, the rotor-stator assembly functions the same as previously discussed embodiments. Embodiments constructed in accordance with the preferred maximum SD/Sd ratios described herein and shown in Table 1 enable a reduced eccentricity, and reduced centrifugal forces, regardless of whether the stator includes an elastomeric liner.

Figure 9:
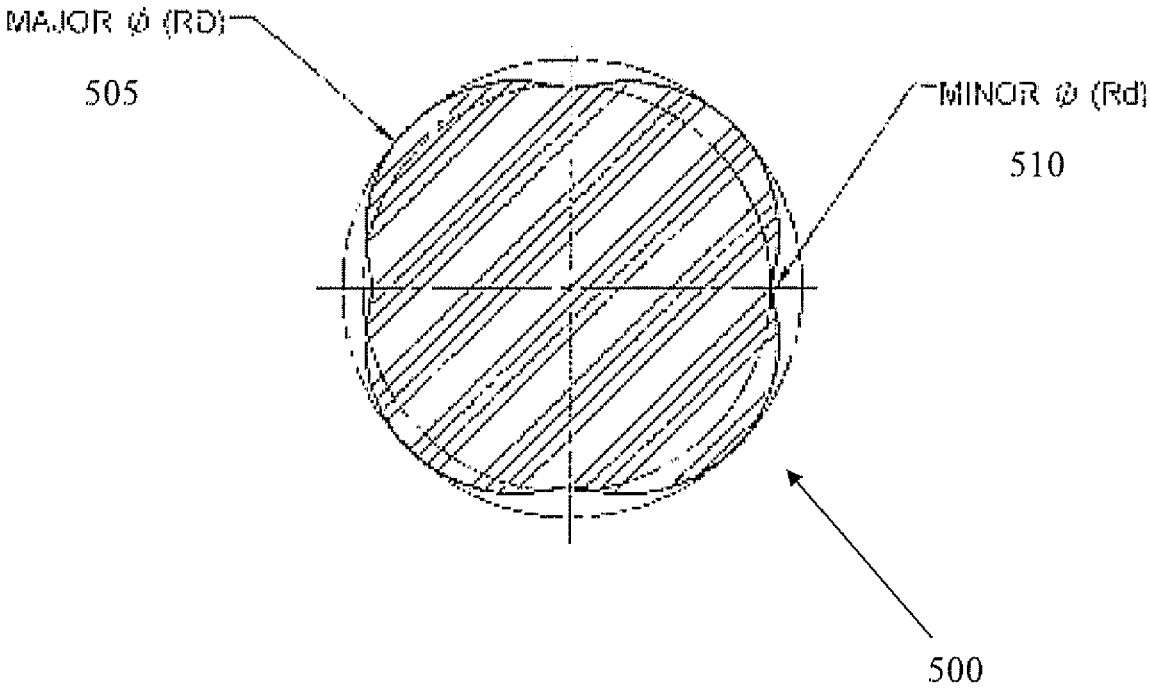
FIG. 9 depicts one illustrative embodiment of a rotor with a four lobe configuration in accordance with the principles described herein.

FIGS. 6 and 8 depict representative embodiments of stators constructed in accordance with the principles described herein. While these figures do not also depict a rotor, it is to be understood that in operation, a rotor will be disposed within each stator constructed in accordance with the principles disclosed herein, including those depicted in FIGS. 6 and 8, to form a PCP or power section of a PDM. Each such rotor will also be constructed generally in accordance with the SD/Sd ratios disclosed in Table 1 above, meaning the ratio of the rotor major diameter to the rotor minor diameter will satisfy the maximum SD/Sd values listed in this table with slight differences to provide an interference fit between the rotor and the stator within which the rotor will be disposed. The interference fit creates the seal lines between the inner surface of the stator and the outer surface of the rotor. For example, FIG. 9 depicts a four lobe rotor 500 constructed in accordance with the principles disclosed herein. In operation, it will preferably be assembled inside a five-lobe stator also constructed in accordance with the principles disclosed herein, such as the stator 200 depicted in FIG. 6 and/or the stator 400 depicted in FIG. 8, to form a PCP or power section of a PDM. The four-lobe rotor 500 depicted in FIG. 9 is constructed to also satisfy the SD/Sd ratio criteria disclosed in Table 1, meaning the rotor 500 is constructed such that the ratio of its major diameter 505 to its minor diameter 510 will be less than or equal to 1.263.

While various embodiments of a low eccentricity rotor-stator assembly for a positive displacement pump and/or progressive cavity pump have been shown and described herein, modifications may be made by one skilled in the art without departing from the spirit and the teachings herein. The embodiments described are representative only, and are not intended to be limiting. Many variations, combinations, and modifications of the applications disclosed herein are possible and are within the scope of the invention. Accordingly, the scope of protection is not limited by the description set out above, but is defined by the claims which follow, that scope including all equivalents of the subject matter of the claims.

What is claimed is:

1. A stator comprising:

an inner surface including a plurality of lobes, wherein the plurality of lobes define a major diameter circumscribing the plurality of lobes and a minor diameter inscribing the plurality of lobes;

wherein a stator ratio is equal to the major diameter divided by the minor diameter; and wherein the stator ratio is selected from the group consisting of 1.350 or less for a stator with two lobes, 1.263 or less for a stator with three lobes, 1.300 or less for a stator with four lobes, 1.250 or less for a stator with five lobes, 1.180 or less for a stator with six lobes, 1.175 or less for a stator with seven lobes, 1.150 or less for a stator with eight lobes, 1.125 or less for a stator with nine lobes, and 1.120 or less for a stator with ten lobes.

2. The stator of claim 1 further comprising a liner, wherein the liner forms the inner surface of the stator.

3. The stator of claim 2, wherein the liner comprises an elastomer.

4. The stator of claim 2 further comprising a housing having a through bore, wherein the liner is disposed within the through bore of the housing.

5. The stator of claim 4, wherein the housing comprises steel.

6. The stator of claim 5, wherein the housing is heat-treated.

7. The stator of claim 4, wherein the housing has a cylindrical inner surface that engages an outer surface of the liner.

8. The stator of claim 4, wherein the liner has a uniform wall thickness.

9. A rotor comprising:

an outer surface having at least one lobe, wherein the at least one lobe defines a major diameter circumscribing the at least one lobe and a minor diameter inscribing the at least one lobe;

wherein a rotor ratio is equal to the major diameter divided by the minor diameter; and wherein the rotor ratio is selected from the group consisting of 1.350 or less for a rotor with one lobe, 1.263 or less for a rotor with two lobes, 1.300 or less for a rotor with three lobes, 1.250 or less for a rotor with four lobes, 1.180 or less for a rotor with five lobes, 1.175 or less for a rotor with six lobes, 1.150 or less for a rotor with seven lobes, 1.125 or less for a rotor with eight lobes, and 1.120 or less for a rotor with nine lobes.

10. The rotor of claim 9, wherein the rotor comprises carbon steel.

11. The rotor of claim 10, wherein the rotor is chrome plated.

12. The rotor of claim 9, wherein the rotor is coated for wear resistance.

13. A progressive cavity device comprising:

a stator having an inner surface including a first number of lobes, wherein the first number of lobes define a major diameter circumscribing said first number of lobes and a minor diameter inscribing said first number of lobes;

a rotor including a second number of lobes disposed within the stator, wherein the second number of lobes is different than the first number of lobes;

wherein a rotor-stator ratio equals the major diameter divided by the minor diameter; and wherein the rotor-stator ratio is selected from the group consisting of 1.350 or less for a progressive cavity device with a stator having two lobes, 1.263 or less for a progressive cavity device with a stator having three lobes, 1.300 or less for a progressive cavity device with a stator having four lobes, 1.250 or less for a progressive cavity device with a stator having five lobes, 1.180 or less for a progressive cavity device with a stator having six lobes, 1.175 or less for a progressive cavity device with a stator having seven lobes, 1.150 or less for a progressive cavity device with a stator having eight lobes, 1.125 or less for a progressive cavity device with a stator having nine lobes, and 1.120 or less for a progressive cavity device with a stator having ten lobes.

14. The device of claim 13 wherein the stator further comprises an outer housing surrounding an inner liner, wherein the inner liner forms the inner surface of the stator.

15. The device of claim 14, wherein the inner liner has a uniform wall thickness.

16. The device of claim 14, wherein the outer housing has a cylindrical inner surface that engages an outer surface of the liner.

17. The device of claim 13, wherein the stator is made entirely of steel.

18. An apparatus comprising:

a stator having an inner surface including a plurality of lobes, wherein the plurality of lobes define a major diameter circumscribing the plurality of lobes and a minor diameter inscribing the plurality of lobes; and a rotor disposed within the stator, wherein the rotor has an outer surface including at least one lobe;

wherein a rotor-stator ratio equals the major diameter divided by the minor diameter;

and wherein the rotor-stator ratio is selected from the group consisting of 1.350 or less for a progressive cavity device with a stator having two lobes, 1.263 or less for a progressive cavity device with a stator having three lobes, 1.300 or less for a progressive cavity device with a stator having four lobes, 1.250 or less for a progressive cavity device with a stator having five lobes, 1.180 or less for a progressive cavity device with a stator having six lobes, 1.175 or less for a progressive cavity device with a stator having seven lobes, 1.150 or less for a progressive cavity device with a stator having eight lobes, 1.125 or less for a progressive cavity device with a stator having nine lobes, and 1.120 or less for a progressive cavity device with a stator having ten lobes.

19. The apparatus of claim 18, wherein the stator is free of an elastomeric liner.

20. The apparatus of claim 19, wherein the stator is made entirely of steel.

21. The apparatus of claim 18, wherein the stator comprises a housing having a through bore and an elastomeric liner disposed within the through bore.

22. The apparatus of claim 18 further comprising a shaft coupled to the rotor, wherein the shaft is supported by one or more bearings.

* * * * *